US010792532B1

(12) United States Patent
Hall et al.

(10) Patent No.: US 10,792,532 B1
(45) Date of Patent: Oct. 6, 2020

(54) BELT SQUAT WITH CABLE-DRIVEN LEVER ARM

(71) Applicant: Arsenal Strength LLC, Knoxville, TN (US)

(72) Inventors: Richard Andrew Hall, Knoxville, TN (US); Bradley J. Holt, Knoxville, TN (US); Nathan Lillie, Altoona, WI (US)

(73) Assignee: Arsenal Strength LLC, Knoxville, TN (US)

( * ) Notice: Subject to any disclaimer, the term of this patent is extended or adjusted under 35 U.S.C. 154(b) by 0 days.

(21) Appl. No.: 16/831,298

(22) Filed: Mar. 26, 2020

(51) Int. Cl.

| | |
|---|---|
| ***A63B 21/00*** | (2006.01) |
| ***A63B 21/06*** | (2006.01) |
| ***A63B 21/062*** | (2006.01) |
| ***A63B 23/04*** | (2006.01) |

(52) U.S. Cl.
CPC ..... *A63B 21/159* (2013.01); *A63B 21/062* (2013.01); *A63B 21/0615* (2013.01); *A63B 21/154* (2013.01); *A63B 21/4009* (2015.10); *A63B 21/4034* (2015.10); *A63B 21/4035* (2015.10); *A63B 23/0405* (2013.01); *A63B 2023/0411* (2013.01); *A63B 2225/093* (2013.01)

(58) Field of Classification Search
CPC . A63B 21/159; A63B 21/4034; A63B 21/154; A63B 23/0405; A63B 21/0615; A63B 21/062; A63B 21/4009; A63B 21/4035; A63B 2023/0411; A63B 2225/093; A63B 21/06–08; A63B 22/04
See application file for complete search history.

(56) References Cited

U.S. PATENT DOCUMENTS

| | | | | | |
|---|---|---|---|---|---|
| 3,558,130 | A * | 1/1971 | Anderson | A63B 21/4043 | 482/72 |
| 4,226,414 | A * | 10/1980 | Coffaro | A63B 21/0615 | 482/97 |
| 4,407,495 | A * | 10/1983 | Wilson | A63B 21/0615 | 482/138 |
| 4,838,545 | A * | 6/1989 | Wilson | A63B 1/00 | 403/234 |
| 4,923,195 | A * | 5/1990 | Calderone | A63B 21/0615 | 482/97 |
| 4,951,939 | A * | 8/1990 | Peters | A63B 21/0615 | 482/94 |
| 5,058,884 | A * | 10/1991 | Fuller, Sr. | A63B 21/0615 | 473/438 |
| 5,250,013 | A * | 10/1993 | Brangi | A63B 21/0615 | 482/137 |
| 5,358,462 | A * | 10/1994 | Calderone | A63B 21/0615 | 482/102 |

(Continued)

*Primary Examiner* — Nyca T Nguyen
(74) *Attorney, Agent, or Firm* — Chambliss, Bahner & Stophel, P.C.; Stephen D. Adams

(57) ABSTRACT

A belt squat apparatus having a frame and a lever arm that is pivotally mounted to a pivot point of the frame. A weight loading point is located on the first side of the lever arm and on one side of the pivot point. An attachment point is located on the second side of the lever arm. A cable includes a lever end that is configured to mount to the lever arm at the attachment point and an opposing user end that is configured to engage a user. When the user pulls the cable, the lever arm pivots about the pivot point to move the weight loading point from a lowered position to a raised position.

12 Claims, 7 Drawing Sheets

(56) References Cited

U.S. PATENT DOCUMENTS 5,372,556 A * 12/1994 Ropp ..... A63B 21/0615 482/133
5,529,558 A * 6/1996 Koenig ..... A63B 21/0615 482/137
5,554,084 A * 9/1996 Jones ..... A63B 21/0615 482/134
5,637,063 A * 6/1997 Fuller, Sr. ..... A63B 21/0615 482/137
5,688,216 A * 11/1997 Mauriello ..... A63B 21/154 482/101
5,776,039 A * 7/1998 Perez, Jr. ..... A63B 21/055 482/121
6,203,474 B1 * 3/2001 Jones ..... A63B 21/0615 482/97
6,726,607 B1 * 4/2004 Ihli ..... A63B 21/015 482/115
7,029,426 B1 * 4/2006 Fuller, Sr. ..... A63B 21/0615 482/137
7,442,153 B1 * 10/2008 Chasnov ..... A61H 1/0292 482/140
7,470,221 B1 * 12/2008 Ramos ..... A63B 21/154 482/100
7,608,020 B2 * 10/2009 Mason ..... A63B 21/0615 482/105
8,147,389 B1 * 4/2012 Hoole ..... A63B 23/1227 482/100
8,172,731 B1 * 5/2012 Bredda ..... A63B 21/00065 482/94
9,486,660 B2 * 11/2016 Hoole ..... A63B 21/0421
9,511,258 B2 * 12/2016 Hoole ..... A63B 23/1236
9,539,460 B2 * 1/2017 Ellis ..... A63B 21/0615
10,220,233 B2 * 3/2019 Schmidt ..... A63B 21/06
10,293,206 B2 * 5/2019 Kamins ..... A63B 21/0552
10,350,127 B2 * 7/2019 Kelly ..... A63B 22/0087
10,441,845 B2 * 10/2019 Moreno ..... A63B 69/0057
2004/0092368 A1 * 5/2004 Gramaccioni ..... A63B 22/0064 482/70
2004/0242383 A1 * 12/2004 Karlstrom ..... A63B 21/06 482/93
2005/0148445 A1 * 7/2005 Carle ..... A63B 21/4035 482/97
2007/0197353 A1 * 8/2007 Hundley ..... A63B 69/0059 482/93
2009/0131231 A1 * 5/2009 Smith ..... A63B 21/06 482/99
2009/0312160 A1 * 12/2009 Higgins ..... A63B 69/345 482/94
2010/0222190 A1 * 9/2010 Miskech ..... A63B 23/03541 482/142
2010/0261586 A1 * 10/2010 Williamson ..... A63B 21/4047 482/94
2010/0285934 A1 * 11/2010 Abelbeck ..... A63B 21/00072 482/97
2014/0073492 A1 * 3/2014 Hunter ..... A63B 21/4047 482/98
2014/0256516 A1 * 9/2014 Calderone ..... A63B 23/03525 482/98
2014/0371036 A1 * 12/2014 Ellis ..... A63B 21/4033 482/66
2015/0105223 A1 * 4/2015 Bissu ..... A63B 21/00076 482/99
2015/0133274 A1 * 5/2015 Simonetti ..... A63B 21/4034 482/98
2016/0258573 A1 * 9/2016 Goldish ..... A63B 71/0622
2017/0203149 A1 * 7/2017 D'Amico ..... A63B 21/4009
2017/0246504 A1 * 8/2017 Simmons ..... A63B 21/0626
2017/0282002 A1 * 10/2017 Lee ..... A63B 71/0619
2017/0319905 A1 * 11/2017 O'Connor ..... A63B 21/0628
2018/0353798 A1 * 12/2018 Chung ..... A63B 21/00069
2020/0038704 A1 * 2/2020 Adams ..... A63B 21/4009
2020/0094096 A1 * 3/2020 Sorin ..... A63B 21/00072
2020/0121974 A1 * 4/2020 Bear ..... A63B 21/0724

* cited by examiner

BELT SQUAT WITH CABLE-DRIVEN LEVER ARM

TECHNICAL FIELD

This invention relates generally to belt squat machines. More particularly, the invention relates to a belt squat machine having a lever-type weighted arm that is driven by a cable secured to a user's hips.

BACKGROUND OF THE INVENTION

Squat type exercises, such as the front or back squat, are useful for developing the anterior chain (e.g., quadriceps, core, pectoral muscle groups) and posterior chain (e.g., hamstrings, glutes, lats, scapular retractors, and rotator cuff muscle groups). Often these exercises are carried out using weight-loaded barbells that are positioned either onto a user's back or across their chest and shoulders. The belt squat is a squat variation where a load is supported by a user's pelvis (e.g., hips) instead of their back or chest and shoulders. Often, when performing a belt squat, a belt having a hook is placed around the user's waist and free weights or a weighted bar is suspended from the hook. For this reason, the term "belt squat" is used interchangeably with "hip squat." One of the primary advantages of the belt squat, particularly for those with back injuries, is that significant loads can be used without loading the spine. Instead, the weight is carried by the hips only. Additionally, it is easier to maintain an erect spine throughout the movement, which reduces the risk of back injury. Another benefit of the belt squat is that it emphasizes increased hip extension and glute activation over other squat methods.

However, there are several issues associated with a conventional belt squat apparatus. For example, the machine itself can create a tripping hazard and provides a somewhat limited range of motion. Often, a conventional belt squat apparatus that works with free weights (versus a weight stack) uses a weighted rod that is pivotally mounted at one end and that is mounted to the user at the other end. As the user squats, the end of the bar connected to the user travels in an arc about the pivot location and, therefore, moves towards and away from the user throughout the exercise. Additionally, the user must be careful to avoid tipping on the bar and the depth of the squat can be limited if the bar is permitted to touch the ground surface. Additionally, a conventional belt squat apparatus is somewhat specialized and does not typically allow for other types of movements or exercises to be performed using the same machine. For many gyms, including particularly small gyms having limited numbers of machines, efficient use of space is a concern. Machines that can be used for multiple types of exercise are beneficial for maximizing efficient use of the space.

What is needed, therefore, is a belt squat apparatus that addresses at least these issues.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, coupling and the like, such as "connected" and "interconnected", refer to a relationship wherein structures are secured or attached to one another either directly or indirectly through intervening structures, as well as both moveable and rigid attachments or relationships, unless specified herein or clearly indicated by context. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity.

BRIEF SUMMARY OF THE INVENTION

The above and other needs are met by a belt squat apparatus having a frame with a pivot point. A lever arm is pivotally mounted to the frame at the pivot point such that a first elongate side of the lever arm is located on one side of the pivot point and a second elongate side of the lever arm is located on an opposite side of the pivot point. A weight loading point is located on and is configured to move with the first side of the lever arm. An attachment point is located on and is configured to move with the second side of the lever arm. The apparatus also includes a cable that has a lever end that is configured to mount to the lever arm via the attachment point. The cable also has an opposing user end that is configured to engage a user. When the user pulls the cable, the lever arm pivots about the pivot point to move the weight loading point from a lowered position to a raised position.

Certain embodiments of the invention include a user platform that is located on the frame and that is configured to support a user at a user space. The user platform may include two foot platforms that are separated by a space, where each foot platform is configured to support a foot of a user. In certain cases, a pulley system routes the cable from the attachment point of the lever arm along the frame to at least one pulley of the pulley system that is located below the user and then upwards to the user. Preferably, the pulley system includes a front and back pulley assembly that routes the cable from the lever arm, downwards to the frame below the user, along the frame towards the user, and then upwards from directly below the user through the space between the two foot platforms to the user. Additionally, in preferred embodiments, each of the foot platforms is independently moveable. The user platform has a front end and a back end. In some cases, the user platform may be rotated such that the front end is vertically higher than the back end. In some cases, the user platform may be rotated such that the front end is vertically lower than the back end.

In certain embodiments, the weight loading point includes an elongate horn that is mounted to the lever arm. The horn has a tip that is configured for insertion through a center opening of a weight plate and a base that is opposite the tip. In certain embodiments, the tip of the horn is positioned vertically higher than the base of the horn. In certain embodiments, the tip of the horn is positioned further away from the pivot point, in a horizontal direction, than the base of the horn.

Certain embodiments of the invention include an elongate arm extending upwardly from the frame. A handle portion is formed on the elongate arm and is configured to be grasped by a user of the apparatus. In certain preferred embodiments, a first lock member is located on the elongate arm and a second lock member is located on the lever arm. The second lock member engages the first lock member in an engaged position and is disengaged from the first lock member in a disengaged position. When the second lock member is in the disengaged position, the weight loading point of the lever arm is located at a first vertical height with respect to the frame. When the second lock member is in the engaged position, the weight loading point of the lever arm is located at a second vertical height with respect to the frame that is vertically higher than the first vertical position. In certain embodiments, the first lock member is movable along the elongate arm and may be selectively fixed in at least two positions along a length of the elongate arm. In certain embodiments, the elongate arm is pivotably mounted to the base and is configured to be pivoted towards the lever arm to the engaged position and away from the lever arm to the disengaged position.

In order to facilitate an understanding of the invention, the preferred embodiments of the invention, as well as the best mode known by the inventor for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and in which.

DETAILED DESCRIPTION OF THE INVENTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 1:
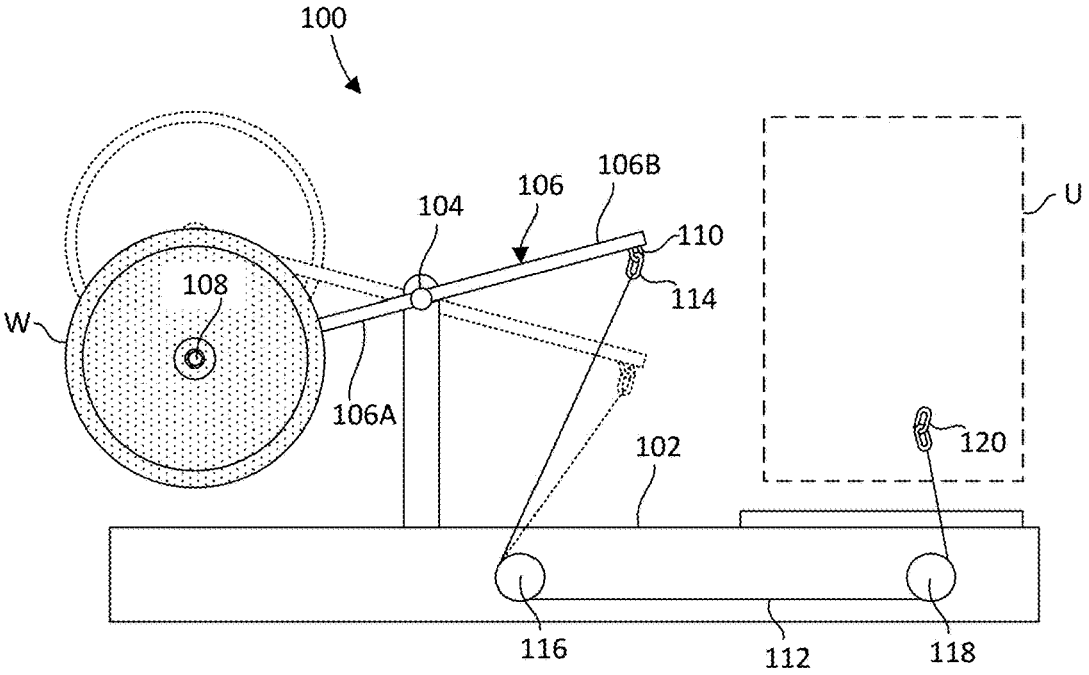
FIG. 1 is a side elevation view of a belt squat apparatus according to a first embodiment of the present invention.

With initial reference to FIG. 1, there is provided a belt squat apparatus 100 according to a first embodiment of the present invention. Using this apparatus 100, a user may stand in a user area U, connect herself to a weight, and then perform a squat type exercise. As described in greater detail below, this apparatus 100 eliminates the need of a rod or other similar obstruction (i.e., tripping hazard) while performing an exercise with the apparatus. Additionally, this apparatus 100 enables a wide variety of other non-squat exercises to be performed (e.g., bicep curls, overhead press, etc.). Lastly, certain embodiments, of the apparatus 100 allow the resistance of a particular exercise to be modified (i.e., increased or decreased) without changing the amount of weight loaded onto the apparatus.

The apparatus 100 includes a frame 102 having a pivot point 104. A lever arm 106 is pivotally mounted to the frame 102 at the pivot point 104. The pivot point 104 separates the lever arm 106 into a first elongate side 106A located on one side of the pivot point and a second elongate side 106B located on the opposite side of the pivot point. A weight loading point 108 is located on and is configured to move with the first side 106A of the lever arm 106. The weight loading point 108 allows a weight W to be mounted on or otherwise connected to the lever arm 106, which weight resists pivoting of the lever arm about the pivot point 104. In this particular case, weight loading point 108 is an elongate weight horn that is fixedly mounted orthogonal to the lever arm 106 (i.e., extending out of the page) and that receives weight plates W. However, in other embodiments, a weight stack, resistance band, or other similar resistance device can be mounted to lever arm 106 at weight loading point 108 in order to resist pivoting of the lever arm about pivot point 104.

Additionally, an attachment point 110 is located on and is configured to move with the second 106B of the lever arm 106. A cable 112 is routed from the lever arm 106 to the user area U. More particularly, in preferred embodiments, the cable 112 includes a lever end 114 that mounts to the lever arm 106 via the attachment point 110. In the illustrated embodiment, the lever end 114 includes a carabiner that is removably connected to ring-like connection point, which functions as the attachment point 110 of the lever arm 106. From that connection point, the cable 112 extends downwards around a first pulley 116 and then along the frame 102 and around a second pulley 118. Finally, an opposing user end 120 of cable 112 extends upwards to a user (not shown) located on top of the frame 102 at the user area U. As the term is used throughout this description, the term "cable"

includes any flexible or easily maneuverable member suited for being routed from weights to the user by traveling below the user, preferably traveling along the frame 102, and then back up to the lever arm 106. For example, the term cable could include a belt, rope, chain, etc., but excludes substantially rigid members such as a bar or rod.

Figure 2:
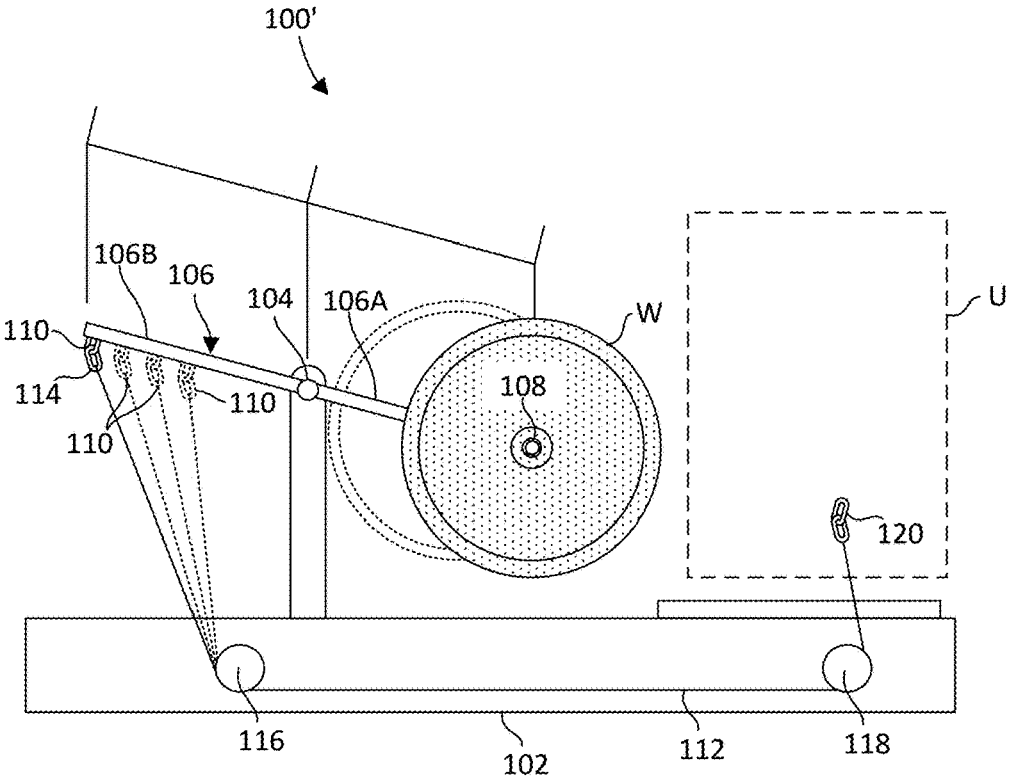
FIG. 2 is a side elevation view of a belt squat apparatus according to a second embodiment of the present invention.

From the above discussion, it may be appreciated that during the performance of an exercise using apparatus 100, when the user pulls the cable 112, the lever arm 106 pivots about the pivot point 104 to move the weight loading point 108, including any weights W located there, from a lowered position to a raised position (shown in dashed lines). Referring now to FIG. 2, there is provided a modified apparatus 100' that functions in an almost identical manner as apparatus 100. One primary structural difference is that the ends of the lever arm 106 are reversed. In particular, in apparatus 100, the attachment point 110 of lever arm 106 is located between the weight loading point 108 and the user area U. However, in apparatus 100', the weight loading point 108 is located between attachment point 110 of lever arm 106 and the user area U.

One advantage of this alternative structure is that it provides easier access to the cable 112. That ease of access could be beneficial in this particular embodiment, where several attachment points 110 are provided along the second elongate side 106B of the lever arm 106. Lever end 114 of the cable 112 may be connected to any of these alternative attachment points 110. The difficulty of an exercise performed using apparatus 100' may be increased or decreased by varying the mounting location of the cable on the lever arm 106. In particular, the difficulty of the exercise may be increased by connecting the cable 112 to the lever arm 106 at a location nearer pivot point 104. Conversely, the difficulty of the exercise may be decreased by connecting the cable 112 to the lever arm 106 at a location further from pivot point 104. In the illustrated embodiment, separate carabiners provide mounting locations 110 for mounting cable 112 to lever arm 106. However, a single movable mounting location 110 may be provided, such as a slidable collar that, when loosened, can slide along the length of the lever arm 106. Similarly, in some embodiments, the weight loading point 108 may also be moved along the length of lever arm 106 to increase or decrease the difficulty of the exercise being performed (alternative position shown in dashed lines). This could be done, for example, by using a slidable collar with a weight mounting location. Modifying the exercise difficulty in the manner discussed above would be useful, for example, to a user such as a small gym or home gym user that had a limited space or a limited number of weights W.

Figure 3:
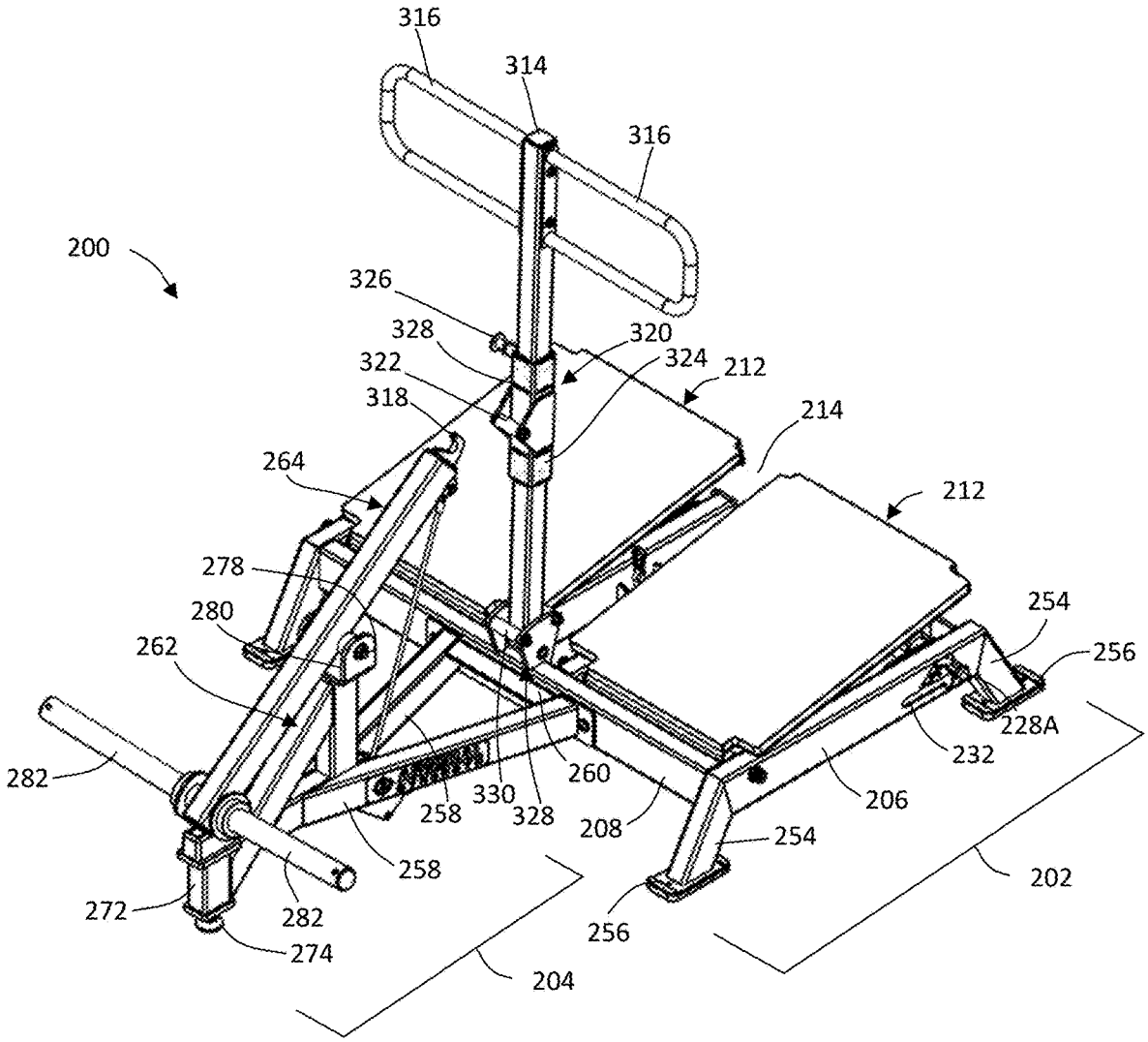
FIG. 3 is a top perspective view of a belt squat apparatus according to a third embodiment of the present invention.
Figure 4:
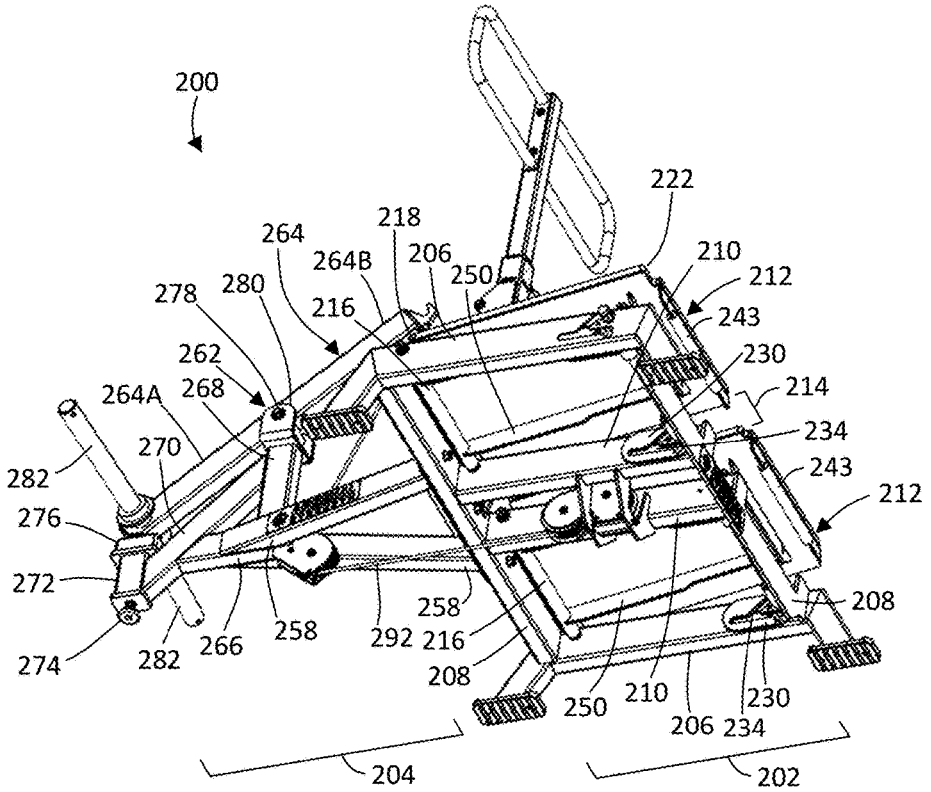
FIGS. 4 and 5 are bottom perspective views of the belt squat apparatus of FIG. 3.
Figure 5:
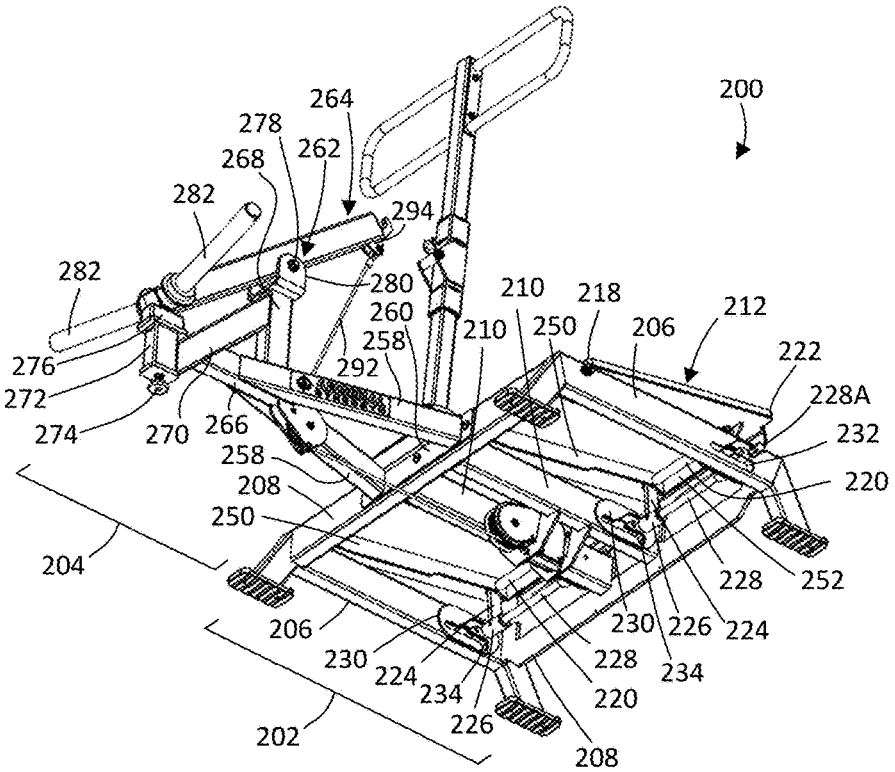

With reference to FIGS. 3-5 a belt squat apparatus 200 according to another embodiment of the present invention is shown. Apparatus 200 includes a frame that is formed by a user support 202 for supporting a user (not shown) and a front leg 204 for supporting weights (also not shown) used by the user in performing an exercise, such as a hip-loaded squat.

The user support 202 includes main frame rails 206 that are located along left and right sides of the frame that are connected together by front and back cross members 208. Intermediate frame rails 210 extend parallel with the main frame rails 206 between the cross members 208 on either side of the center of the user support 202. These frame members 206, 208, 210 provide lower support for a user platform, which is configured to support a user of the exercise apparatus 200. In this particular case, the user platform is comprised of two separate foot platforms 212 that are separated by a space 214 and that are each configured to support a separate foot of a user during the performance of an exercise using apparatus 200. Each of the foot platforms 212 is provided with a deck surface that, in this particular case, is formed using a slip resistant diamond plate sheet metal surface. The foot platforms 212 of apparatus 200 are preferably raised above a ground surface on which the apparatus rests in order to provide an increased range of motion (ROM) for exercises performed with the apparatus. As such, feet 254 extend downwardly from the front and back ends of the main frame rails 206 to space the user area formed above the foot platforms 212 away from the ground surface on which the apparatus 200 is supported. Pad support plates 256 are mounted to each of the feet. Pad support plates 256 have a planar and preferably padded lower surface that rests on the ground surface.

Preferably, foot platforms 212 are independently movable (e.g., tilt-able upwards or downwards). In this case, to provide this motion, a separate front and back pivot assembly is mounted below each of the foot platforms 212, which pivot assemblies allow ends of the foot platforms to be pivoted upwards and downwards. In particular, a front pivot rod 216 is fixedly mounted under a front end 218 of each foot platform 212. An end of each of the front pivot rods 216 is rotatably attached at the main frame rail 206 and an opposite end is rotatably attached at the intermediate frame rail 210.

Additionally, a back pivot rod 220 is fixedly mounted under a back end 222 of each foot platform 212. A pair of elongate deck support braces 250 (one of which is shown for each foot platform 212 in FIG. 5) are placed under each of the foot platforms 212 and provide additional support to support the weight of the user. Braces 250 have a front end that is mounted to the front pivot rod 216 and a back end that is mounted to a gusset plate 252 extending laterally across the foot deck proximate back end 222. The back pivot rod 220 extends through openings formed in the deck support braces 250 and ends of the back pivot rod are rotatably attached to deck support arms 224 (one of which is shown for each foot platform 212 in FIG. 5). A rod mount 226 is fixedly attached at the opposite end of each of the left and right deck support arms 224 located under each foot platform. The left and right rod mounts 226 are rotatably connected to a pivot stop rod 228, which extends laterally below the foot platform 212 parallel with the back pivot rod 220. Ends of the pivot stop rods 228 are inserted into a slotted guide 230 that is fixedly attached to inward-facing surfaces of the main frame rail 206 and intermediate frame rail 210. The purpose of the slotted guide 230 is to constrain the motion of the pivot stop rod 228 and to fix it in two or more desired positions.

Figure 6:
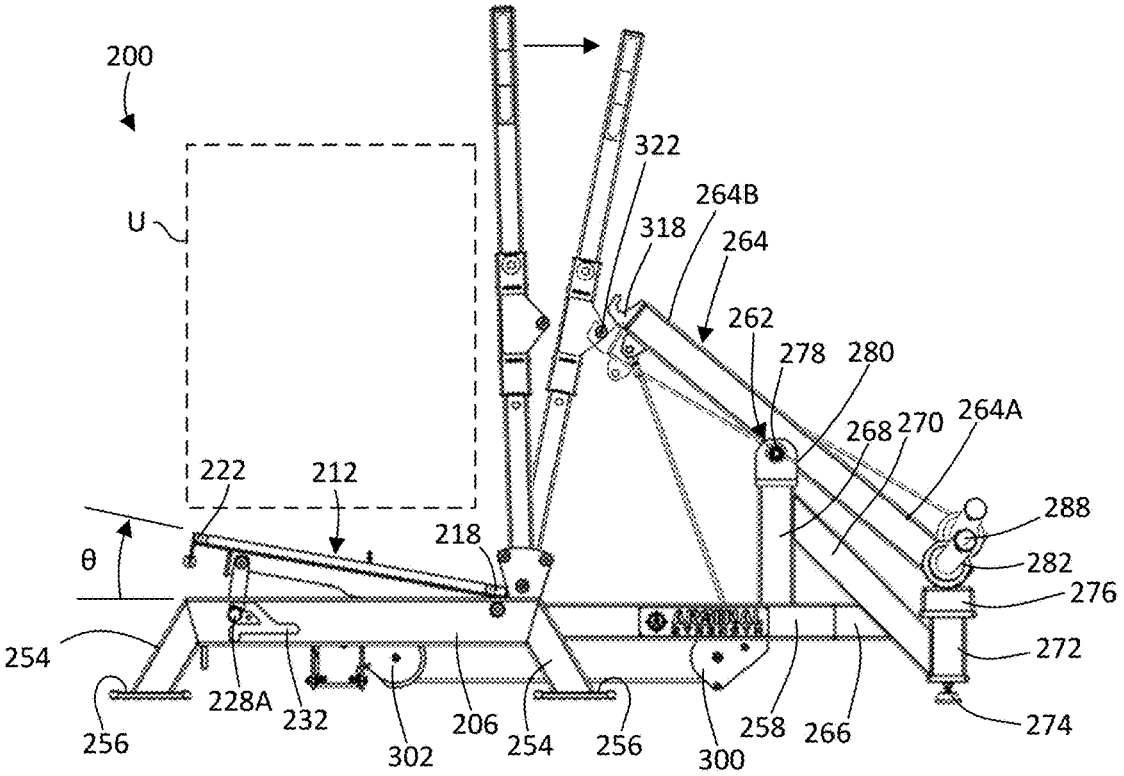
FIG. 6 is a left-side elevation view of the belt squat apparatus of FIG. 3.

An outer end 228A of the pivot stop rod 228 extends through a slot 232 formed in the main frame rail 206 (one of which is shown in FIG. 6) on each of the left and right sides of the apparatus 200. The shape of the slot 232 formed in the main frame rail 206 corresponds to the shape of a corresponding slot 234 formed in the slotted guide 230. Slots 232 and 234 are aligned when guide 230 is attached to main frame rail 206. This allows a user located adjacent one side of the apparatus 200 to raise and lower the foot platforms 212 by grasping outer end 228A of pivot stop rod 228 and then sliding the pivot stop rod along the slots 232, 234. Preferably, a non-slip cover is provided on outer end 228A of the pivot stop rod 228. However, preferably, an opposite end of the pivot stop rod 228, does not pass through the intermediate frame rail 210 or into the space 214 between the foot platforms 212.

Figure 7:
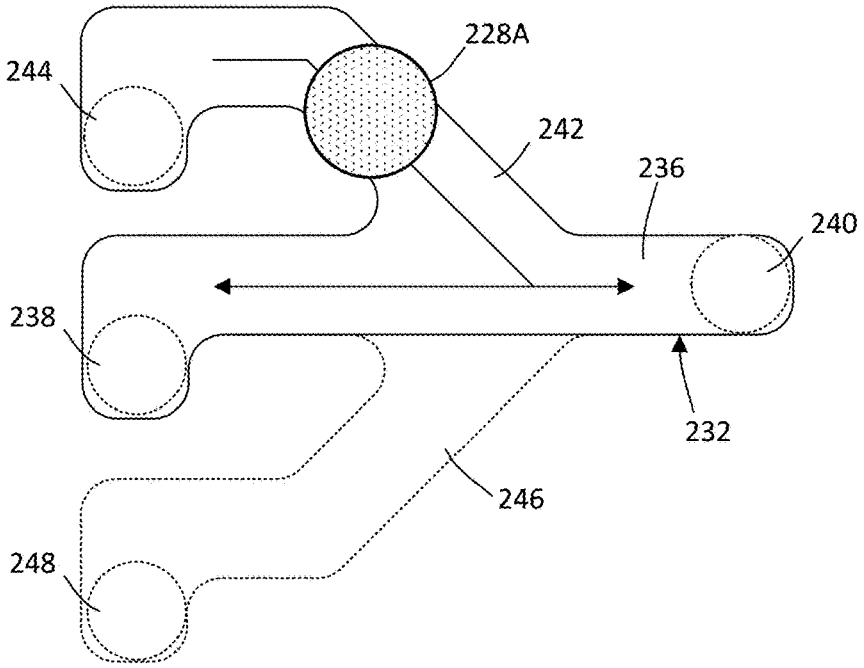
FIG. 7 depicts a slot formed in a portion of a user support of the apparatus of FIG. 3.

An enlarged image of slot 232 and outer end 228 of a pivot stop rod 228 moving along the slot is illustrated in FIG. 7. The slot 232 in this particular embodiment includes a lower horizontal portion 236 having an indent at one end 238 and no indent at the opposite end 240. An upwardly sloped portion 242 extends away from a center portion of the top of the horizontal portion 236 and terminates with an end 244 having a second indent. Conveniently, the pivot stop rod 228 (FIG. 5) can be moved along slots 232, 234 using outer end 228A while the user is adjacent the apparatus 200 to, in conjunction with back handle 243, raise and lower foot platforms 212. The pivot stop rod 228 is configured to slide along horizontal portion 236 and to drop into the indent at end 238 to secure the foot platform 212 in a slightly tilted orientation (e.g., 5° of incline), upwards along sloped portion 242 and to drop into the indent at end 244 to secure the foot platform in a more tilted orientation (e.g., 10° of incline), or to the opposite end 240 for a horizontal orientation (e.g., 0° of incline). End 240 does not require an indent to fix the pivot stop rod 228 because the downward force of the weight of the user would tend to drive the pivot stop rod 228 along horizontal portion 236 against end 240.

As discussed above, in this particular embodiment, the foot platform 212 may be rotated such that the back end 222 is vertically higher than the front end 218. However, in other cases, the foot platforms 212 may each be rotated such that the front end 218 is vertically higher than the back end 222. This could be achieved, for example, by allowing front pivot rod 216 to be moved along a guide having a slot that is similar to slot 234. Alternatively, guide 230 and main frame rails 206 may be provided with slots 232, 234 having a downwardly sloped portion 246 that extends away from the bottom of the horizontal portion 236 and terminates with an end 248 having a third indent (e.g., 10° of decline). Additionally, other slot configurations can be provided to allow for more and different angles of incline of the foot platforms 212. Additionally, an infinitely adjustable incline may be provided, for example, by using a screw to raise and lower the platform 212. Thus, preferably, each foot platform 212 may be oriented horizontally and may be tilted by an angle θ of approximately ±0-25° about the front end 218 from a horizontal plane.

Referring again to FIGS. 3-6, front leg 204 includes angled side support tubes 258 attached to a main mounting plate 260. The main mounting plate 260 is attached to a front-facing surface of the front cross member 208 in order to connect user support 202 to front leg 204. A pivot support 262 is mounted between the side support tubes 258 and supports a lever arm 264. The pivot support 262 includes a first pivot support member 266 that extends horizontally between the side support tubes 258, a second pivot support member 268 that extends vertically from the first pivot support member, and a third pivot support member 270 that extends diagonally between a front end of the first pivot support member and a top end of the second pivot support member. Finally, a front leg 272 is mounted to the bottom of the third pivot support member 270. The bottom of the front leg 272 is provided with a padded leveling foot 274 that may be used to level the apparatus 200. A padded (e.g., rubber) dock bumper 276 is positioned on the top of the front leg 272.

Figure 9:
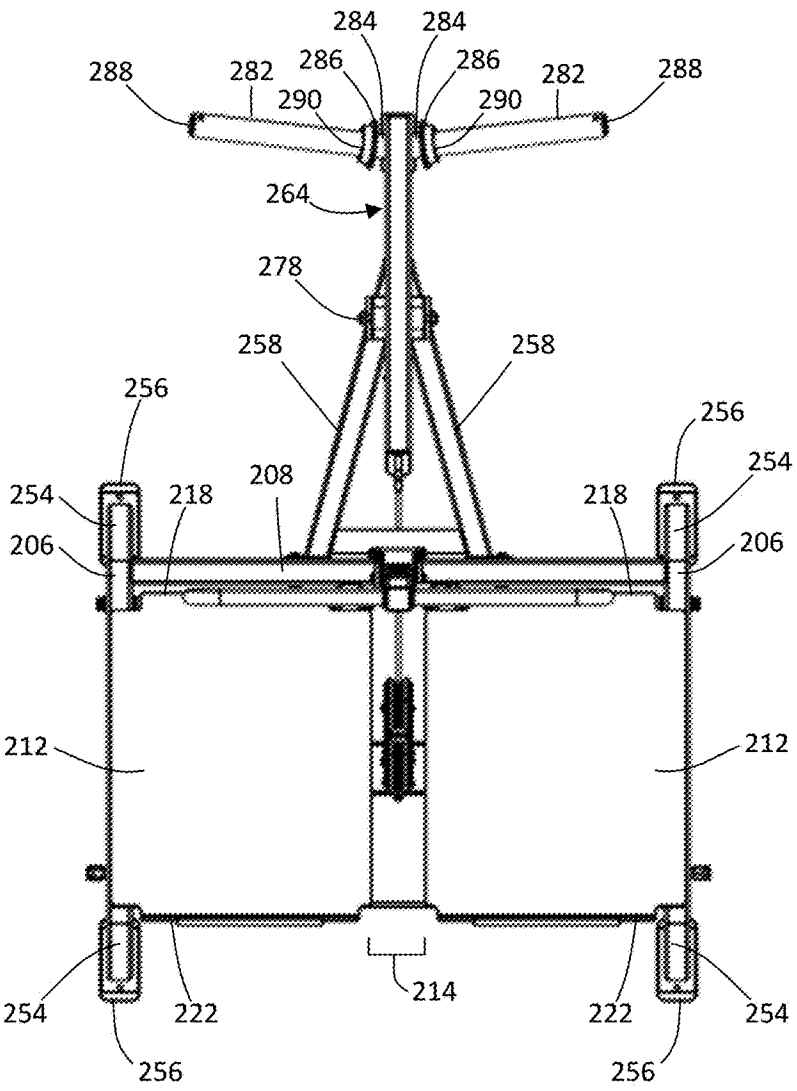
FIGS. 8 and 9 are bottom and top plan views, respectively, of the belt squat apparatus of FIG. 3.
Figure 8:
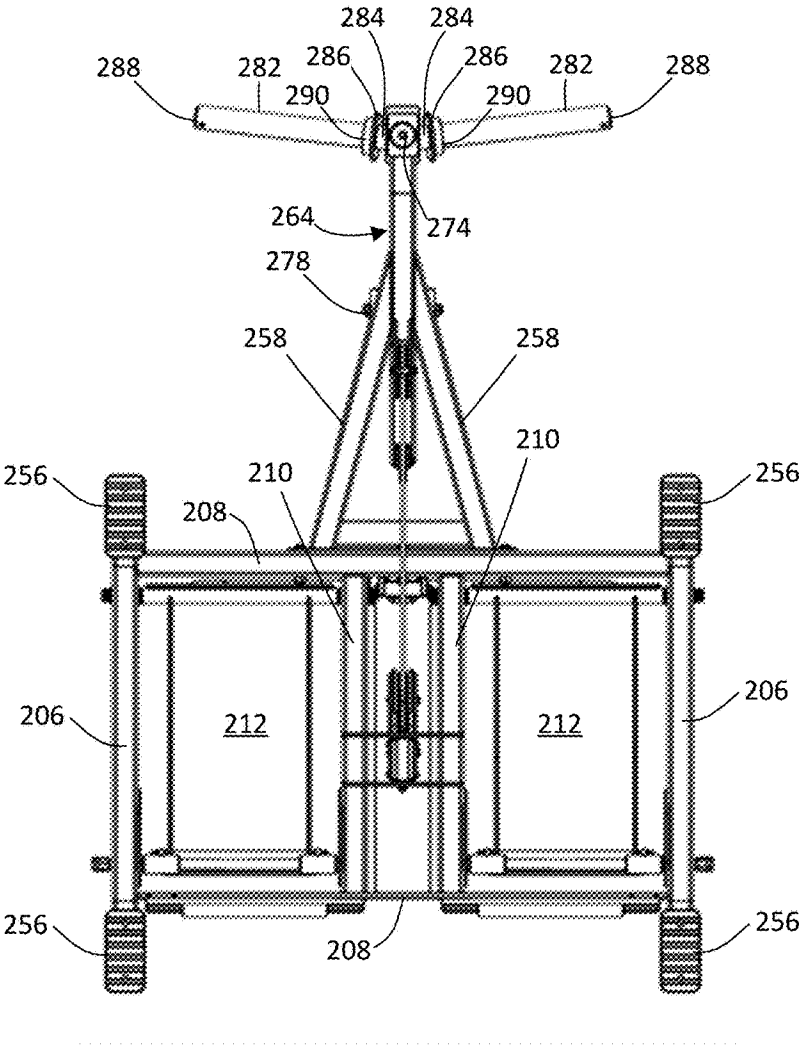
Figure 11:
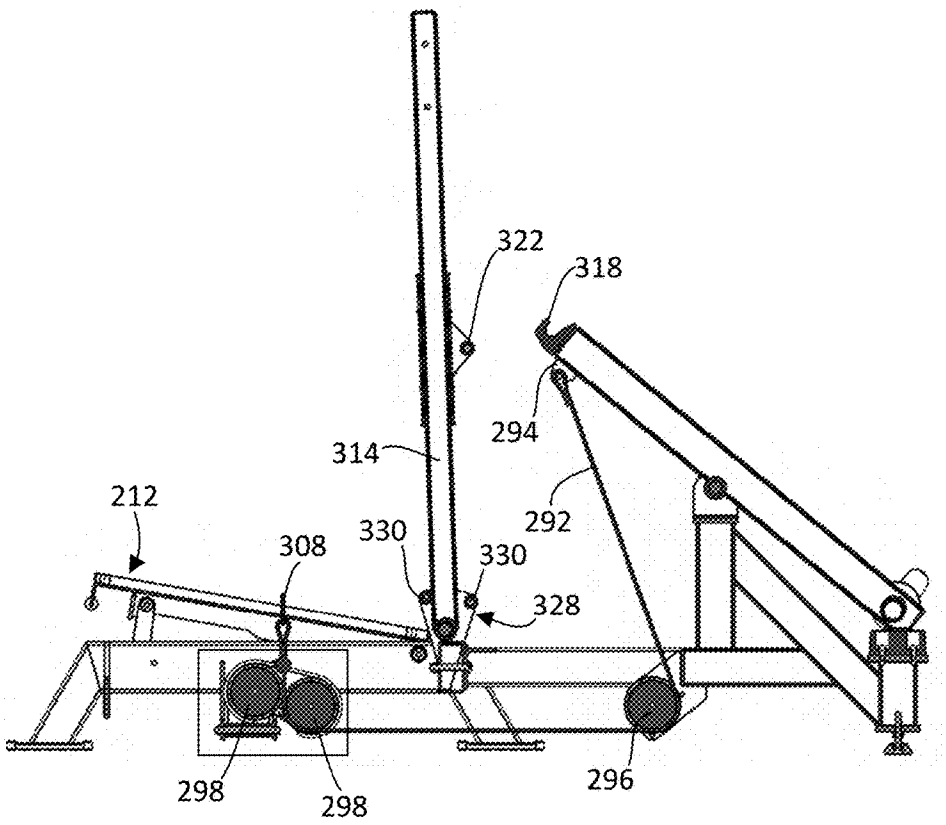
FIG. 11 is a sectional view taken along line "11-11" in FIG. 10.
Figure 10:
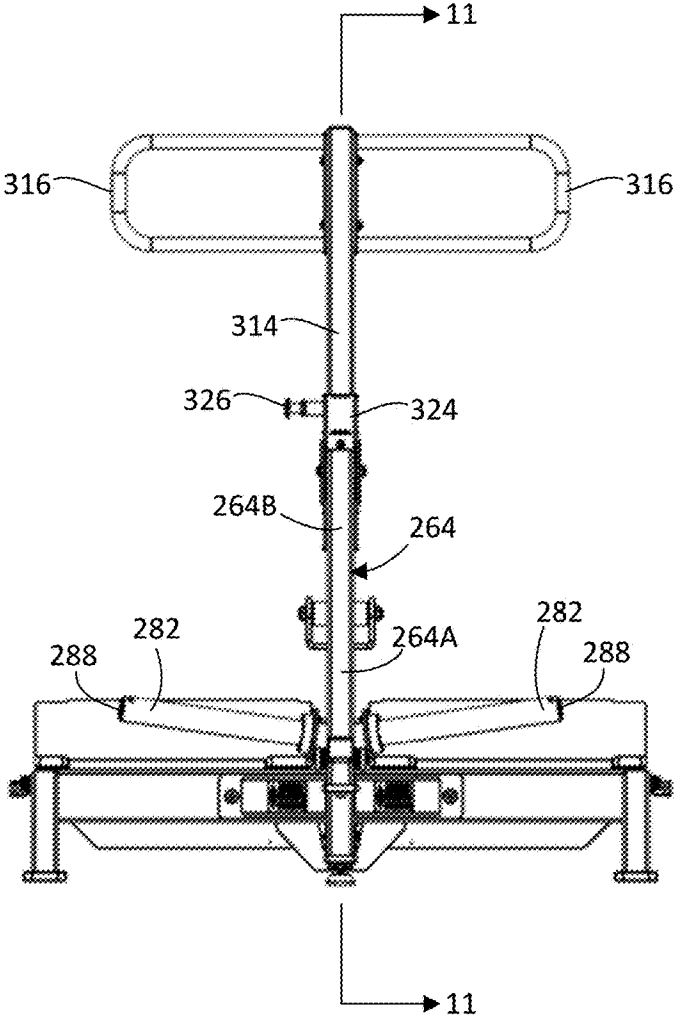
FIG. 10 is a front elevation view of the belt squat apparatus of FIG. 3.
Figure 12:
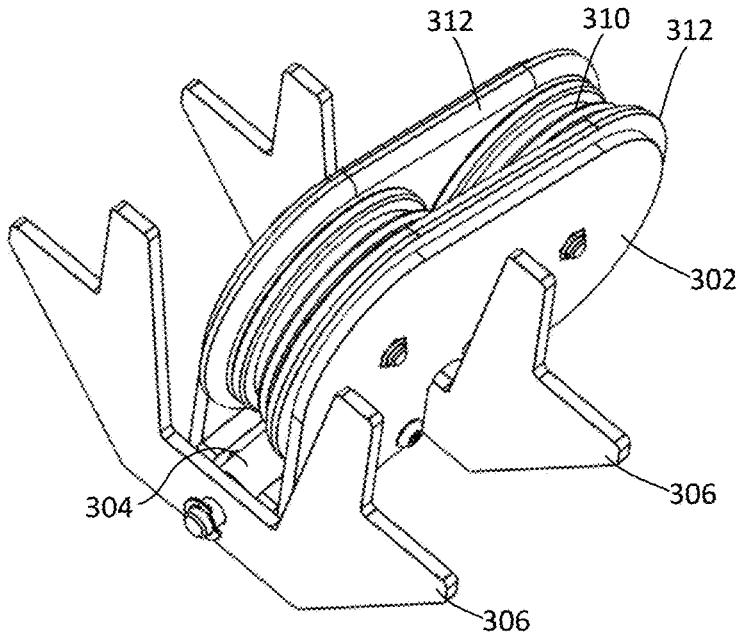
FIG. 12 is a top perspective view illustrating a rear pulley assembly of the belt squat apparatus of FIG. 3.
Figure 13:
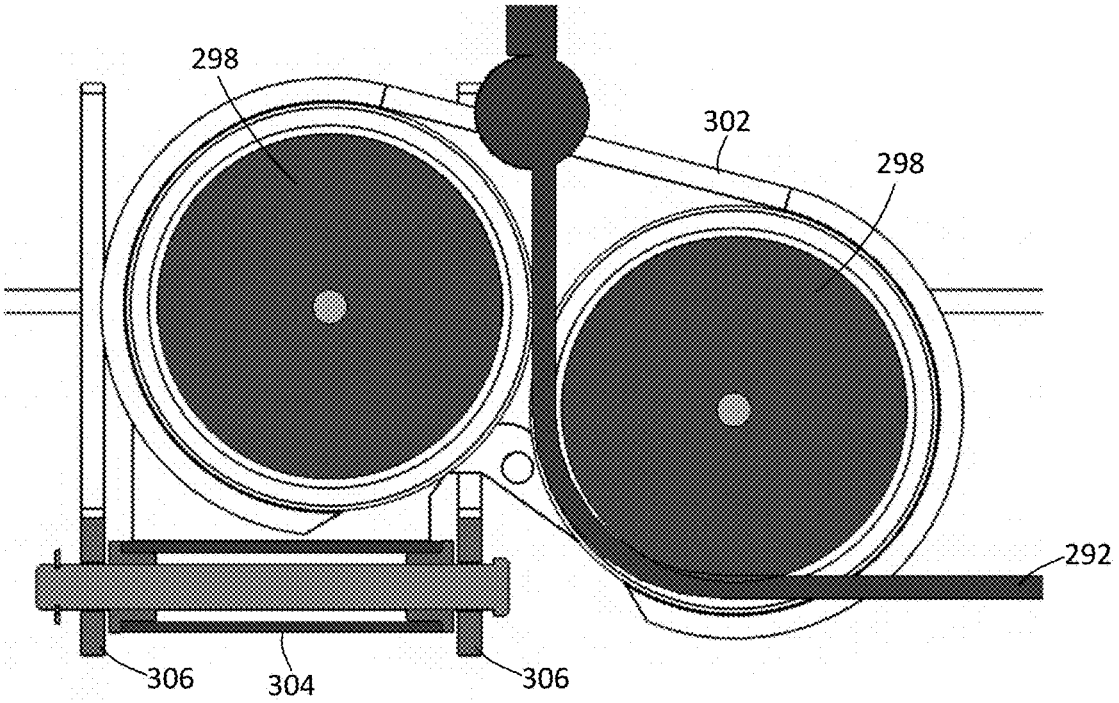
FIG. 13 is a cutaway view of the rear pulley of FIG. 12.

With continue reference to FIGS. 6 and 7 and with further reference to FIG. 8, lever arm 264 is pivotally mounted to the pivot support 262 at a pivot point 278 within U-shaped bracket 280 mounted to a top end of the second pivot support member 268. The lever arm 264 includes an elongate arm having a front end 264A located on one side of the pivot point 278 and a back end 264B located on the opposite side of the pivot point. Elongate weight horns 282 (i.e., weight loading portions) are mounted to and extend laterally outwards from opposite sides of the front end 264A of the lever arm 264. Horns 282 include a base 284 and a stop plate 286 that is mounted to the lever arm 264 and a tip 288 that is opposite the base. Rubber donut-shaped bumpers 290 are removably placed onto the horns 282 and are positioned adjacent the stop plate 286. When apparatus 200 is loaded with weights, a center opening of a weight plate, such as weight W shown in FIG. 1, is placed over tip 288 of horn 282. The weight plate slides along the horn 282 and rests against bumper 290 and stop plate 286. As shown best in FIGS. 8 and 9, the horns 282 are angled forward, such that the tip 288 is further away from cross member 208 than base 284. Additionally, as shown best in FIG. 10, the horns 282 are angled upwards, such that the tip 288 is vertically higher than the base 284. Slightly angling horns 282 in this manner provides easier access for loading and unloading weights from the horns. Additionally, angling the horns 282 upwards helps to ensure weights remain firmly in place at the base 284 against bumper 290 and stop plate 286.

Referring again to FIGS. 4 and 5 and with further reference to FIGS. 10-13, apparatus 200 is also provided with a cable 292 that is connected to the lever arm 264 and that is routed, via front and back pulley assemblies, to the user area formed above the foot platforms 212. One end of the cable 292 is mounted to a swivel connection 294 at an end of the lever arm 264. In certain embodiments, two or more swivel connections 294 may be positioned along the back end 264B of the lever arm. As discussed above, the force required to raise a given weight placed onto horn 282 can be varied simply by connecting the cable 292 to the lever arm 264 at various positions along the along the back end 264B of the lever arm. In other embodiments, the cable 292 is connected to a movable swivel connection that is configured to slide along the length of the back end 264B of the lever arm and that can be fixed at a desired position. From the swivel connection 294, the cable 292 travels downwards and around a front pulley 296, rearwards between a pair of back pulleys 298, and then upwards from directly below the user through the space 214 (FIG. 4) between the foot platforms 212.

The front pulley 296 is rotatably secured between a pair of front pulley plates 300 that are fixedly mounted to a back end of the first pivot support member 266. The back pulleys 298 are rotatably secured between swivel plates 302. The swivel plates 302 are each connected to a pivot tube 304 and then the pivot tube is connected between a pair of back pulley plates 306. Lastly, back pulley plates 306 are fixedly connected to intermediate frame rails 210 to position the back pulleys 298 in the space 214. As such, an end of cable 292, which may include a carabiner 308 (or another suitable device for connecting to a user or other exercise equipment, e.g., bar or rope attachment), extends upwards through the space 214 from below the user. Each of the front and back pulleys 296, 298 preferably includes a pulley wheel 310 and wear plates 312 located on either side of the pulley wheel and between the pulley plates 300, 304. In preferred embodiments, pulley wheels 310 are configured to rotate within back pulley 298 in order to better track movement of carabiner 308. For example, pulley wheel 310 may be configured to rotate up 20° in a side-to-side direction about a vertical axis passing through a rotational center of the pulley wheel. In certain embodiments, pulley wheel 310 of the front pulley 296 can also rotate in a similar manner.

With reference to FIGS. 3 and 6, apparatus 200 also includes a movable handle that is comprised of an elongate arm 314 that extends upwards from a front end of user support 202 and a handle portion 316 that is configured to be grasped by a user of the apparatus. The arm 314 is pivotably mounted to cross member 208 and is configured to move between a rearward position and a forward position. The distance that the arm 314 is permitted to pivot is limited by a range limiter 328 that includes stationary horizontal front and back bars 330 that engage the elongate arm 314. A first lock member 318 located on the elongate arm 314 is configured to engage a second lock member 320 located on the lever arm 264 when the elongate arm is in the forward position. In this case, the second lock member 320 includes a horizontal bar 322 located on a sliding tube 324 that is configured to slide along the length of the elongate arm 314 and to be fixed in two or more locations by a pop pin 326 that engages the elongate arm. Individual low-friction shims 328 are placed on each of the four sides of the sliding tube to reduce friction with the elongate arm 314. The first lock member 318 in this case is a hook formed at the rear-most end of lever arm 264. When the first lock member 318 (i.e., the hook) is engaged with the horizontal bar 322 of the second lock member 320 (i.e., bar), the lever arm 264 is fixed in a partially raised or rest position, as shown in FIG. 6.

It can be seen from the above that, even though the apparatus 200 utilizes free weights that travel in an arching path as a result of mounted to a pivoting lever arm, the location of the downwards force on the user remains fixed because the pulleys below the user remain fixed. As such, a constant downwards from acts on the user throughout the exercise. Additionally, the apparatus 200 eliminates the tripping hazard and the limitations on the range of motion by eliminating the guide rod that is traditionally placed between the user's legs. Additionally, a user can easily attach other exercise equipment, such as a bar or rope attachment, to the cable in order to perform a variety of other exercises using the apparatus 200.

Although this description contains many specifics, these should not be construed as limiting the scope of the invention but as merely providing illustrations of some of the presently preferred embodiments thereof, as well as the best mode contemplated by the inventor of carrying out the invention. The invention, as described and claimed herein, is susceptible to various modifications and adaptations as would be appreciated by those having ordinary skill in the art to which the invention relates.

What is claimed is:

1. A belt squat apparatus comprising:

a frame having a pivot point;

a lever arm pivotally mounted to the frame at the pivot point such that a first elongate side of the lever arm is located on one side of the pivot point and a second elongate side of the lever arm is located on an opposite side of the pivot point;

a weight loading point located on and configured to move with the first elongate side of the lever arm;

an attachment point located on and configured to move with the second elongate side of the lever arm; and a cable having a lever portion that is configured to mount to the lever arm via the attachment point and an opposing user portion that is configured to engage a user, wherein when the user pulls the cable the lever arm pivots about the pivot point to move the weight loading point from a lowered position to a raised position;

a user platform comprised of two foot platforms separated by a space, each foot platform configured to support a foot of said user;

a pulley system configured to route the cable from the attachment point of the lever arm along the frame to at least one pulley of the pulley system that is located below the user and then upwards through the space between the two foot platforms to the user.

2. The apparatus of claim 1 wherein the weight loading point comprises an elongate horn mounted to the lever arm, the horn having a tip that is configured for insertion through a center opening of a weight plate and a base that is opposite the tip.

3. The apparatus of claim 2 wherein the tip of the horn is positioned vertically higher than the base of the horn.

4. The apparatus of claim 2 wherein the tip of the horn is positioned further away from the pivot point, in a horizontal direction, than the base of the horn.

5. The apparatus of claim 1 further comprising:

an elongate arm extending upwardly from the frame; and a handle portion formed on the elongate arm configured to be grasped by said user of the apparatus.

6. The apparatus of claim 5 wherein the handle portion is formed on the elongate arm and is configured to be grasped by said user of the apparatus, wherein the elongate arm is pivotably mounted to the frame and is configured to be pivoted towards the lever arm to an engaged position and away from the lever arm to a disengaged position.

7. The apparatus of claim 1 further comprising:

an elongate arm pivotally mounted to the frame and configured to pivot between an engaged position and a disengaged position;

a first lock member disposed on said elongate arm;

a second lock member disposed on the lever arm that is configured to engage the first lock member when the elongate arm is in the engaged position and to be disengaged from the first lock member when the elongate arm is in the disengaged position, wherein, when the first lock member is engaged with the second lock member, the weight loading point of the lever arm is held at an intermediate position between the lowered position and the raised position.

8. The apparatus of claim 7 wherein the first lock member is slidable along the elongate arm and is configured to be selectively fixed in at least two positions along a length of the elongate arm, wherein the vertical height of the intermediate position at which the weight loading point is held with respect to the frame changes depending on the position of the first lock member with respect to the elongate arm.

9. The apparatus of claim 1 wherein each of the foot platforms is independently moveable.

10. The apparatus of claim 1 wherein the user platform comprises a front end and a back end and wherein the user platform is configured to be rotated such that the front end is vertically higher than the back end.

11. The apparatus of claim 1 wherein the user platform comprises a front end and a back end and wherein the user platform is configured to be rotated such that the front end is vertically lower than the back end.

12. A belt squat apparatus comprising:

a frame having a pivot point;

a lever arm pivotally mounted to the frame at the pivot point such that a first elongate side of the lever arm is located on one side of the pivot point and a second elongate side of the lever arm is located on an opposite side of the pivot point;

a weight loading point located on and configured to move with the first elongate side of the lever arm;

an attachment point located on and configured to move with the second elongate side of the lever arm; and a cable having a lever portion that is configured to mount to the lever arm via the attachment point and an opposing user portion that is configured to engage a user, wherein when the user pulls the cable the lever arm pivots about the pivot point to move the weight loading point from a lowered position to a raised position;

a user platform comprised of two independently movable foot platforms separated by a space, each foot platform configured to support a foot of said user.

* * * * *